United States Patent [19]

Mowbray

[11] Patent Number: 4,572,138

[45] Date of Patent: Feb. 25, 1986

[54] FUEL INJECTION PUMPING APPARATUS

[75] Inventor: Dorian F. Mowbray, Burnham, England

[73] Assignee: Lucas Industries public limited company, Birmingham, England

[21] Appl. No.: 712,914

[22] Filed: Mar. 18, 1985

Related U.S. Application Data

[63] Continuation of Ser. No. 465,044, Feb. 9, 1983, abandoned.

[30] Foreign Application Priority Data

Feb. 20, 1982 [GB] United Kingdom ..... 8205051

[51] Int. Cl.[4] ..... F02M 41/00

[52] U.S. Cl. ..... 123/450; 417/462

[58] Field of Search ..... 123/450; 417/462, 252, 417/253

[56] References Cited

U.S. PATENT DOCUMENTS

| | | | |
|---|---|---|---|
| 3,485,225 | 12/1969 | Bailey et al. | 123/450 |
| 3,663,123 | 5/1972 | Fenne | 417/462 |
| 3,802,808 | 4/1974 | Kemp | 417/462 |
| 4,382,751 | 5/1983 | Potter | 123/450 |

FOREIGN PATENT DOCUMENTS

| | | | |
|---|---|---|---|
| 2037365 | 7/1980 | United Kingdom | 123/450 |
| 2054754 | 2/1981 | United Kingdom | 123/450 |

*Primary Examiner*—Magdalen Y. C. Moy

[57] ABSTRACT

A fuel injection pumping apparatus for supplying fuel to an internal combustion engine comprises a rotary distributor member having a transverse bore mounting pumping plungers arranged to be moved inwardly by cam lobes on a cam ring. The outward movement of the plungers is controller by varying the axial position of the distributor member. Fuel flows from the bore by way of a delivery passage to an outlet and also when the distributor member is set to provide low fuel delivery through a restricted passage and a flow channel. The period in terms of degrees of rotation of the distributor member for a given displacement of fuel through the outlet is extended as compared with an apparatus in which the restricted passage and flow channel are not provided. The cam ring is also angularly adjustable and the restricted passage and flow channel are positioned so that flow of fuel through the restricted passage ceases as the cam ring moves angularly with increasing speed.

5 Claims, 5 Drawing Figures

FUEL INJECTION PUMPING APPARATUS

Figure 1:
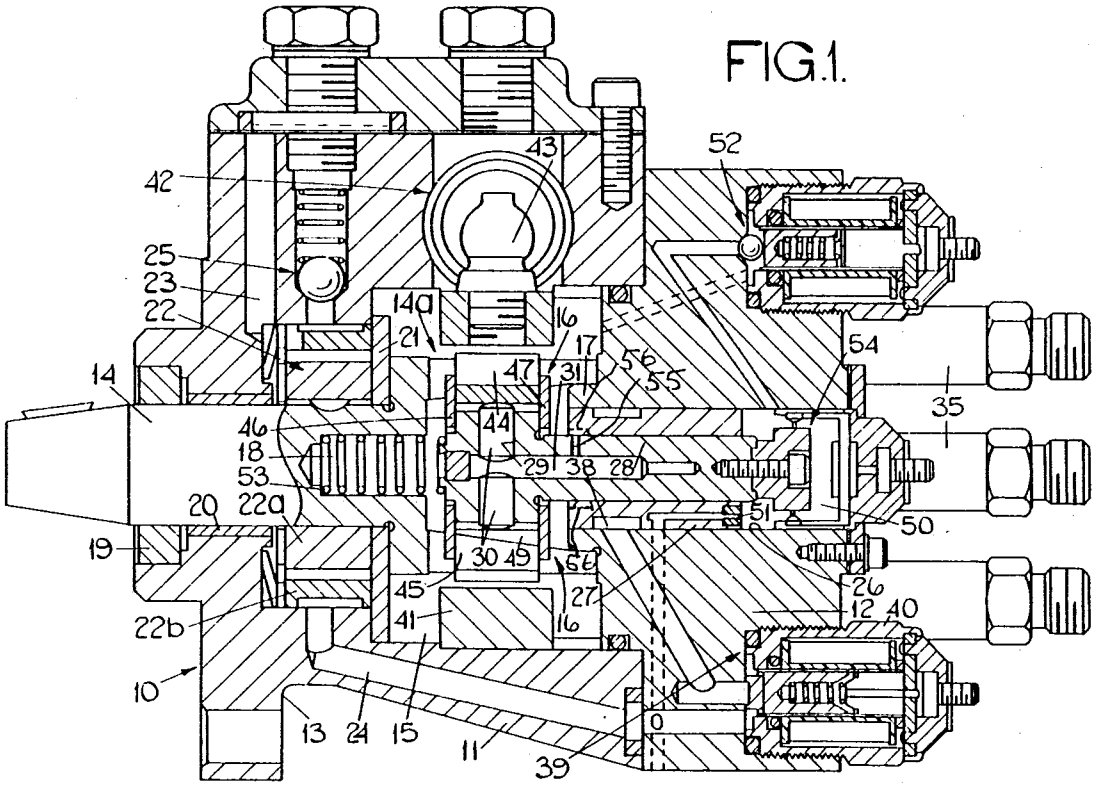

This application is a continuation of application Ser. No. 465,044, filed Feb. 9, 1983 and now abandoned.

This invention relates to a fuel injection pumping apparatus of the kind comprising a body part in which is mounted an axially movable and rotatable distributor member, said distributor member in use, being driven in timed relations with an associated engine, a transverse bore formed in the distributor member and a pumping plunger therein, a passage in the distributor member in communication with the bore and opening to the periphery of the distributor member, an annular cam ring having cam lobes for imparting inward movement to the plunger as the distributor member rotates, outlet ports in the body, said outlet ports being positioned to register with said fuel passage in turn as the distributor member rotates, while inward movement is imparted to the plunger, means for feeding fuel to said bore to effect outward movement of the plunger, stop means operable to limit the extent of outward movement of the plunger while fuel is supplied to said bore, the extent of outward movement of the plunger depending upon the axial position of the distributor member.

A pumping apparatus of the kind set forth is described in the British published application 2037365A and as the distributor member is moved to reduce the amount of fuel supplied to the engine the interval in terms of degrees of rotation of the distributor member during which fuel is delivered to the engine is decreased. The effect therefore is that while the quantity is reduced, the rate of fuel delivery remains substantially the same. As a result, the time interval during which small quantities of fuel are delivered to the engine is short and the combustion period is also short and this leads to sharp rises in pressure in the combustion chamber and the so-called "diesel knock" which is particularly noticeable at engine idle.

The object of the present invention is to provide an apparatus of the kind specified in a form in which the delivery of small quantities of fuel by the apparatus is at a reduced rate and takes place over an extended interval.

According to the invention an apparatus of the kind specified includes an additional passage in the distributor member, said additional passage communicating with said bore and opening to the periphery of the distributor member, flow apertures in said body and with which said additional passage can communicate during inward movement of the plunger and means for restricting the rate of fuel flow through said additional passage, said additional passage being positioned so that fuel flow through said flow apertures is prevented after a predetermined axial movement of the distributor member in the direction to increase the amount of fuel supplied by the apparatus.

According to a further feature of the invention said cam ring is angularly adjustable in accordance with speed to adjust the position of the distributor member at which inward movement of the plunger takes place, said additional passage and/or said flow apertures being positioned such that fuel flow through said additional passage is prevented when the speed of rotation of the distributor member is above a predetermined value.

Figure 2:
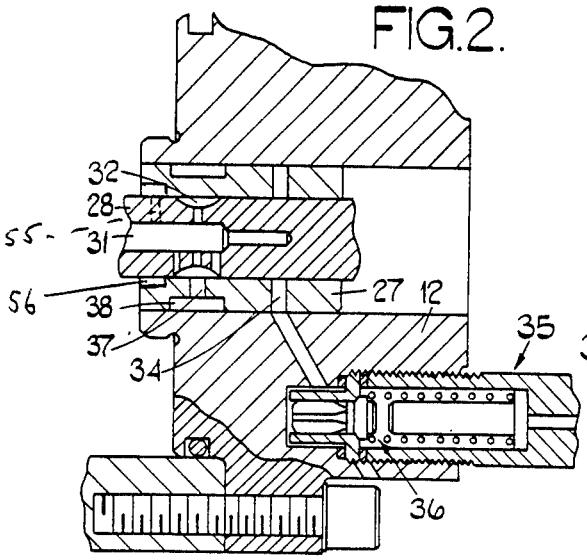
Figure 3:
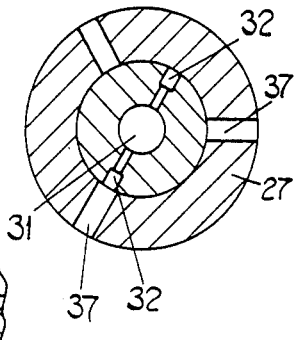
Figure 4:
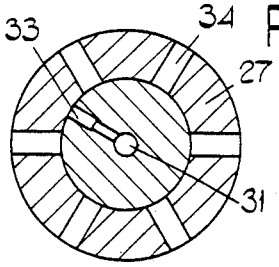
Figure 5:
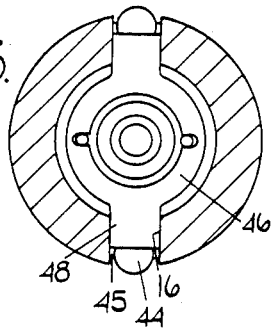

An example of an apparatus in accordance with the invention will now be described with reference to the accompanying drawings in which:

FIG. 1 is a sectional side elevation of one example of the apparatus,

FIG. 2 is a section of a part of the apparatus seen in FIG. 1 taken along a different radial plane, FIGS. 3 and 4 are sections through parts of the apparatus seen in FIGS. 1 and 2, FIG. 5 is a section through part of the apparatus seen in FIG. 1, Referring to FIG. 1 of the drawings, the apparatus comprises a body part generally indicated at 10 and which conveniently is formed by a generally cup shaped portion 11 the open end of which is closed by a closure portion 12. The body portion 10 is provided with apertured lugs 13 whereby in use the apparatus can be secured to the engine with which it is associated.

The body portion 11 mounts a rotary drive shaft 14 which in use, is coupled to a drive member of the associated engine so that the drive shaft is rotated in synchronism with the engine. The drive shaft 14 extends into the generally cylindrical chamber 15 defined by the two body portions and has an enlarged cup shaped portion 14*a* within the chamber. The enlarged portion is provided with a pair of diametrically disposed slots 16. The enlarged portion of the drive shaft is hollow and at its end remote from the smaller diameter portion of the shaft, the inner surface is of right cylindrical form and locates about a spigot portion 17 defined by the body portion 12. The remainder of the interior surface of the enlarged portion of the drive shaft tapers for a purpose which will be described. Moreover, the drive shaft is provided with a counter bore 18. An oil seal 19 is provided at the outer end of the body portion 10 for engagement with the drive shaft 14 and a sleeve bearing 20 supports the shaft for rotation, the shaft being given additional support by the spigot 17. The shaft is located against axial movement by thrust surfaces which engage with the end surfaces of the enlarged portion of the shaft. In one case the thrust surface is defined directly by the body portion 12 whilst in the other case, the thrust surface is defined by an annular plate 21 which surrounds the drive shaft and which additionally serves as an end closure for a low pressure fuel supply pump 22. The rotor 22*a* of the supply pump is carried by the drive shaft 14 and the rotor in turn carries vanes which co-operate with an eccentrically disposed surface on a stator ring 22*b* which is carried within a body portion 11. The low pressure pump has a fuel inlet 23 connected to a fuel inlet 23*a* in a housing secured to the body portion 11 and a fuel outlet 24. Moreover, a relief valve 25 is provided to ensure that the output pressure of the pump remains within desired limits, the relief valve being connected between the inlet and the outlet.

Formed in the body portion 12 is a cylindrical bore 26 in which is fixed a sleeve 27. The sleeve 27 accommodates an angularly and axially movable distributor member 28 which projects into the chamber 15 and has an enlarged head portion lying within the chamber. Formed in the head portion of the distributor member is a transversely extending bore 29 in which is located a pair of pumping plungers 30. The bore 29 communicates with a fuel passage 31 formed in the distributor member and which at its end within the head portion is sealed by means of a plug. As is more clearly shown in FIGS. 2, 3 and 4 the passage 31 communicates with a pair of diametrically disposed longitudinal slots 32 formed in the periphery of the distributor member and communicating with the passage 31 by means of a single or a plurality of connecting passages. The passage 31 also communicates with a further longitudinal slot 33 formed in the periphery of the distributor member and this slot communicates in turn with a plurality of outlet ports 34 formed in the sleeve 27 and as seen in FIG. 2, the outlet ports 34 communicates with outlets 35 respectively in the body portion 12. Each outlet incorporates a conventional form of delivery valve 36. The slots 32 register in turn with inlet ports 37 formed in the sleeve 27 and communicating with a circumferential groove 38 formed in the periphery of the sleeve. The groove 38 as shown in FIG. 1, communicates with the outlet 24 of the low pressure pump 22 by way of an on/off valve 39 conveniently controlled by an electromagnetic device 40. If desired a single slot 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example three pairs of lobes are provided since the apparatus is intended to supply fuel to a six cylinder engine. Moreover, the cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are a pair of followers each of which comprises a roller 44 carried in a shoe 45. The followers are retained axially relative to the distributor member by a pair of side plates 46, 47 which are secured to the side faces of the head portion of the distributor member. Conveniently as shown in FIG. 5, the side plates are of annular form and have a pair of outwardly extending tongues 48, which locate in the slots 16 formed in the enlarged portion of the drive shaft. In FIG. 5 the plate 46 is seen, the plates acting to transmit rotary motion to the distributor member from the drive shaft. The shoes 45 are also located within the aforesaid slots 16 and the rotary motion is transmitted to the shoes directly by the drive shaft. Moreover, the circumferential side faces of the shoes are provided with circumferentially extending projections 49 the radially outer surfaces of which are tapered to co-operate with the tapered surface formed on the internal surface of the enlarged portion of the drive shaft 14.

In use, when fuel is supplied to the bore 29, upon registration of a groove 32 with an inlet passage 37, the plungers 30 are moved outwardly by the fuel pressure and in so doing impart outward movement to the shoes 45 and the rollers 44. The outward movement is limited by the abutment of the tapered surfaces on the shoes and shaft and by moving the distributor member axially the extent of outward movement can be varied. Thus the amount of fuel supplied to the bore 29 can be controlled and this in turn determines the amount of fuel delivered through an outlet when the plungers 30 are moved inwardly by a pair of cam lobes.

The axial position of the distributor member can be varied mechanically or hydraulically. In the arrangement described the variation is achieved by varying the pressure within a chamber 50 defined by the end of the bore 26 in the body portion 12. The end of the bore 26 is closed by a closure member and fuel under pressure is supplied to the chamber 50 by way of a restricted orifice 51 carried by the sleeve 27. The orifice 51 communicates with the outlet 24 of the pump 22. Fuel is allowed to escape from the chamber 50 so that the pressure in the chamber can be controlled, by way of an electromagnetically controlled valve 52. Moreover, the distributor member is biased by means of a coiled compression spring 53 which is housed within the blind bore 18 formed in the drive shaft 14. The spring 53 acts between the drive shaft and the distributor member and urges the distributor member against the action of fuel under pressure in the chamber 50 which acts on the distributor member.

By varying the pressure in the chamber 50 using the valve 52 so the axial position of the distributor member can be varied and therefore the amount of fuel delivered each time the plungers move inwardly can be varied.

In the example as described so far, for a given axial setting of the distributor member and ignoring leakage, the amount of fuel delivered by the plungers will remain the same throghout the speed range of the associated engine and an indication of the axial setting of the distributor member, is provided by a position transducer 54 which is carried on the end closure of the bore 26 and may be adjustably mounted thereon for the purpose of calibration. Conveniently the transducer has a part which is carried by the distributor member. The signal provided by the position transducer can be utilized to provide a signal indicative of the speed rotation of the distributor member and also a signal indicative of its axial position and therefore the amount of fuel being delivered by the apparatus. In use, the signals will be supplied to an electronic control system which additionally is provided with signals representing various engine parameters and the desired engine speed. The control system controls the operation of the valve 52 to ensure that the correct amount of fuel is supplied to the associated engine.

The apparatus as described delivers fuel at a rate which for a constant speed, is determined by the profiles of the leading flanks of the cam lobes. When the quantity of fuel which is being supplied by the apparatus is low and the speed of the associated engine is low it is desirable to be able to reduce the rate at which fuel is delivered by extending the period considered in terms of degrees of engine crank shaft rotation, over which fuel is supplied. This is achieved in accordance with the invention by causing the plungers to displace more fuel than is required to be supplied to the engine and allowing some of the displaced fuel to flow to a drain. It will be appreciated that by causing the plungers to displace more fuel, the period as expressed above, is extended.

As shown in FIG. 1, the distributor member is provided with an additional passage 55 which is in communication with the passage 31 and which opens onto the periphery of the distributor member. The size of the passage 55 is such that it offers a restriction to the flow of fuel. In FIG. 1 the distributor member is shown in a low fuel position and it will be observed that the end of the passage 55 is covered by the wall of the bore in the sleeve 27. There is however formed in the wall of the bore a series of grooves 56, the number of grooves being equal to the number of outlets 34.

The grooves extend inwardly in a longitudinal manner from the end of the sleeve adjacent the cup-shaped portion 14A whereby as the distributor member is moved towards the right to increase the amount of fuel supplied by the apparatus a position will be reached at which the end of the passage 55 is completely covered so that during delivery of fuel, all the fuel displaced by the plungers will be delivered to the associated engine. Prior to the distributor member reaching this position, there will be a range of movement of the distributor member during which as the distributor member is moved towards the right the end of the passage will be progressively obturated by the end wall of the groove. Moreover, before obturation occurs there will be a range of movement of the distributor member during which flow of fuel through the passage 55 into the grooves will be determined by the restrictive nature of the passage only. Ignoring for the moment the fact that the distributor member is rotating, the fact that fuel flow occurs through the passage 55 means that for a given quantity of fuel displaced to the engine the apparatus as modified by the inclusion of the passage 55 and grooves 56 will deliver fuel to the engine over a longer period considered in terms of degrees of engine crankshaft rotation.

The position at which the end of the passage is completely obturated is arranged to occur at a fuel level to suite the particular application for example, about $\frac{1}{3}$ maximum fuel. As the distributor member is moved to this position there will be a progressive increase in the amount of fuel being delivered to the engine and the amount of fuel spilled will be progressively reduced.

The angular relationship of the grooves 56 is such that the passage 55 is rendered ineffective to spill fuel at a speed slightly above the idling speed of the engine for example, in the case of a small automotive engine about 1000 r.p.m. The position of the cam ring 41 is representative of engine speed and as the cam ring is moved angularly the period during which fuel is delivered by the plungers varies within the period during which the groove 33 is in communication with an outlet 34. The grooves 56 are positioned so that the end of the passage 55 is covered at the aforesaid engine speed, during the period the groove 33 is in communication with an outlet. Moreover the end of the passage 55 is uncovered to an increasing extent as the speed is reduced. The effect is therefore that at low engine speeds the end of the passage will be uncovered for the whole of the period of fuel delivery and as the speed increases the end of the passage will be obturated towards the end of fuel delivery the degree of obturation increasing as the speed increases. During the majority of the operation the passage 55 will be covered and the axial position of the rotor will be representative of the quantity of fuel delivered to the engine.

I claim:

1. A fuel injection pumping apparatus comprising a body part in which is mounted an axially movable and rotatable distributor member, said distributor member in use, being driven in timed relationship with an associated engine, a transverse bore formed in the distributor member and a pumping plunger therein, a passage in the distributor member in communication with the bore and opening to the periphery of the distributor member, an annular cam ring having cam lobes for imparting inward movement to the plunger as the distributor member rotates, outlet ports in the body said outlet ports being positioned to register with said fuel passage in turn as the distributor member rotates, while inward movement is imparted to the plunger, means for feeding fuel to said bore to effect outward movement of the plunger, stop means operable to limit the extent of outward movement of the plunger while fuel is supplied to said bore, the extent of outward movement of the plunger depending upon the axial position of the distributor member, means for extending the period of fuel injection during low speed engine operation when small quantities of fuel are being delivered to the engine by reducing the rate at which fuel is delivered, said means including an additional passage in the distributor member, said additional passage communicating with said bore and opening to the periphery of the distributor member, angularly spaced flow apertures in said body and with which said additional passage can communicate during inward movement of the plunger, means for restricting the rate of fuel flow through said additional passage, said additional passage being positioned so that fuel flow through said flow apertures can occur during the pumping action of said pumping plunger which forces fuel out of said transverse bore and engine speed responsive means for adjusting the angular setting of said cam ring, whereby at low engine speeds up to a predetermined speed and when the distributor member is set to provide a low fuel supply through an outlet port, fuel flow takes place through said apertures, the fuel which is lost through said apertures being made up by setting the distributor member to provide an increased fuel flow so that the period of fuel delivery through said outlet port is increased, fuel flow through the apertures ceasing when the engine speed exceeds said predetermined value.

2. An apparatus according to claim 1, in which said flow apertures are defined by axial grooves formed in the internal surface of a sleeve in which the distributor member is rotatably mounted.

3. An apparatus according to claim 2, in which said grooves extend from one end of said sleeve.

4. An apparatus according to claim 3 in which said additional passage is a restricted passage.

5. An apparatus according to claim 1, in which said cam ring is angularly adjustable in accordance with speed and said covering means including means for adjusting the position of the distributor member at which inward movement of the plunger takes place for moving said distributor member into and out of a position covering said additional passage, said flow apertures being positioned such that fuel flow through said additional passage is prevented when the speed of rotation of the distributor member is above a predetermined value.

* * * * *